US011585118B2

(12) United States Patent
Lin et al.

(10) Patent No.: US 11,585,118 B2
(45) Date of Patent: Feb. 21, 2023

(54) DOOR LOCK DEVICE

(71) Applicant: THASE ENTERPRISE CO., LTD., New Taipei (TW)

(72) Inventors: Ching-Tien Lin, New Taipei (TW); Wei-Chun Lin, New Taipei (TW)

(73) Assignee: THASE ENTERPRISE CO., LTD., New Taipei (TW)

( * ) Notice: Subject to any disclaimer, the term of this patent is extended or adjusted under 35 U.S.C. 154(b) by 234 days.

(21) Appl. No.: 17/101,134

(22) Filed: Nov. 23, 2020

(65) Prior Publication Data

US 2022/0056729 A1 Feb. 24, 2022

(30) Foreign Application Priority Data

Aug. 24, 2020 (TW) ..... 109210968

(51) Int. Cl.

| | |
|---|---|
| ***E05B 13/00*** | (2006.01) |
| ***E05B 63/08*** | (2006.01) |
| ***E05B 17/22*** | (2006.01) |
| ***E05B 55/06*** | (2006.01) |
| *E05B 47/06* | (2006.01) |
| *E05B 59/00* | (2006.01) |

(52) U.S. Cl.

CPC ..... *E05B 13/005* (2013.01); *E05B 17/22* (2013.01); *E05B 55/06* (2013.01); *E05B 63/08* (2013.01); *E05B 47/0657* (2013.01); *E05B 59/00* (2013.01); *E05Y 2900/132* (2013.01)

(58) Field of Classification Search

CPC ..... E05B 13/005; E05B 17/044; E05B 17/22; E05B 47/0657; E05B 47/0676; E05B 47/0692; E05B 55/06; E05B 55/12; E05B 59/00; E05B 63/08

See application file for complete search history.

(56) References Cited

U.S. PATENT DOCUMENTS

| | | | | |
|---|---|---|---|---|
| 6,581,423 | B2 * | 6/2003 | Lin | E05B 55/06 70/486 |
| 7,698,918 | B2 * | 4/2010 | Geringer | E05B 47/0676 70/279.1 |
| 9,982,457 | B2 * | 5/2018 | Chen | E05B 17/22 |
| 10,508,471 | B2 * | 12/2019 | Chen | E05B 59/00 |
| 10,626,634 | B2 * | 4/2020 | Verderaime | E05B 63/0069 |
| 10,890,019 | B2 * | 1/2021 | Lien | E05B 63/08 |
| 10,907,381 | B2 * | 2/2021 | Lien | E05B 63/08 |
| 11,408,753 | B2 * | 8/2022 | Chen | E05B 59/00 |
| 2017/0175420 | A1 * | 6/2017 | Chen | E05B 59/00 |

* cited by examiner

*Primary Examiner* — Christopher J Boswell
(74) *Attorney, Agent, or Firm* — Kelly & Kelley, LLP

(57) ABSTRACT

A door lock device is provided and includes: a housing, an acting assembly arranged in the housing and having a lock tongue, an operating assembly arranged in the housing and interlocked with an outdoor handle, and a regulating assembly arranged in the housing for a user to regulate the operating assembly into an interlocking state or an idle state. As such, in the interlocking state, the outdoor handle drives the acting assembly through the operating assembly to cause the lock tongue to extend or retract relative to the housing, and in the idle state, the operating assembly cannot drive the acting assembly and the outdoor handle cannot be interlocked with the lock tongue.

6 Claims, 17 Drawing Sheets

DOOR LOCK DEVICE

CROSS-REFERENCE TO RELATED APPLICATIONS

This application claims priority to Taiwan Application Serial No. 109210968, filed on Aug. 24, 2020. The entirety of the application is hereby incorporated by reference herein and made a part of this specification.

BACKGROUND

1. Technical Field

The present disclosure relates to door lock devices, and more particularly, to a door lock device capable of generating an idle state.

2. Description of Related Art

Conventionally, a door lock is disposed on a door plate and provided with a handle. A user can rotate the handle to operate the door lock, thereby going into or out of a room.

Referring to FIG. 1, a conventional door lock device 1 has a lock head 12 actuateable by a key (not shown), a lock tongue 14 (including a lock bolt 141) actuateable by a rotary handle (not shown), a security bolt 13 for keeping the lock bolt 141 in a locking state, and a handle interlocking structure 15 for driving the lock tongue 14 to actuate. In operation, the lock head 12 and the lock tongue 14 are extended to engage in a lock hole (not shown) and a lock tongue hole (not shown) of a door frame (not shown), respectively. Meanwhile, the lock tongue 14 is blocked by a blocking plate 132 of the security bolt 13. As such, the lock bolt 141 cannot be retracted, thereby keeping the door lock device 1 in a locking state (i.e., the door cannot be opened) and achieving good security.

However, in the conventional door lock device 1, when the door lock device 1 is in a locking state, the rotary handle cannot be rotated due to the restraining effect of the lock tongue 14 being unable to retract. If the rotary handle is forced to rotate at this time, the handle interlocking structure 15 of the door lock device 1 will be damaged. For example, if the rotary handle is impacted by an object or forced to rotate by an unscrupulous person, the handle interlocking structure 15 will be damaged by an improper external force. As such, the door lock device 1 cannot be used normally after being unlocked (i.e., after the lock head 12 is retracted).

Further, the conventional door lock device 1 lacks any fireproof mechanism and cannot meet the requirements of fire doors. Therefore, the door lock device 1 cannot be mounted on a fire door. For example, in the case of a fire in a building, the door lock device 1 cannot be forced to lock. As such, when the fire spreads, the fire door that prevents the fire from spreading indoors may be mistakenly opened by an indoor person, thereby introducing a large amount of air indoors and causing the fire to rush indoors. Consequently, not only the indoor person who mistakenly opens the fire door is burned by the rushing fire, but also other indoor persons fall into a sea of fire.

Therefore, how to overcome the above-described drawbacks of the prior art has become critical.

SUMMARY

In view of the above-described drawbacks, the present disclosure provides a door lock device, which comprises: a housing having a receiving space; an acting assembly arranged in the receiving space and having a lock tongue; an operating assembly arranged in the receiving space and interlocked with a target handle; and a regulating assembly arranged in the receiving space, wherein when the operating assembly is regulated into an interlocking state through the regulating assembly, the target handle drives the acting assembly through the operating assembly to cause the lock tongue to extend or retract relative to the housing, and wherein when the operating assembly is regulated into an idle state through the regulating assembly, the operating assembly is unable to drive the acting assembly and the target handle is unable to be interlocked with the lock tongue.

In an embodiment, the operating assembly has at least one operating mechanism comprising a rotating member engaging with the target handle, a base body disposed around the rotating member, and a sheet body fixed on the base body and disposed around the rotating member. For example, the sheet body has a stop arm for cooperating and actuating with the acting assembly. Alternatively, a sliding slot is formed on a peripheral surface of the base body and in communication with the rotating member. Further, the operating mechanism comprises a sliding block engaging with the sliding slot to abut against or separate from the rotating member along the sliding slot. An elastic element is disposed around the sliding block.

In an embodiment, the acting assembly further comprises a lock tongue base connected to the lock tongue and a fireproof sheet displaceably disposed on the lock tongue base, wherein the fireproof sheet has a security post made of a hot melt material, the security post protrudes into and engages with the lock tongue base, and an acting post is arranged in the receiving space of the housing corresponding to the fireproof sheet.

In an embodiment, the regulating assembly comprises a button pivotally connected to the housing and exposed from the receiving space, a first acting plate and a second acting plate arranged at opposite sides of the button, a rotating sheet axially connected to the housing and passing through the first and second acting plates, an elastic sheet connecting the rotating sheet and the housing, and a rotating plate axially connected to the housing and elastically connected to the rotating sheet, such that in operation, the button is interlocked with one end of one of the first and second acting plates to cause another end of said one of the first and second acting plates to interlock with the rotating plate.

In an embodiment, the regulating assembly comprises a button pivotally connected to the housing and exposed from the receiving space, a rotating plate axially connected to the housing, an electromagnetic valve interlocked with the rotating plate, and a battery actuating the electromagnetic valve, and wherein the button serves as an electrical switch for connecting the battery and the electromagnetic valve through wires.

In an embodiment, the regulating assembly comprises a button pivotally connected to the housing and exposed from the receiving space, a first acting plate and a second acting plate arranged at opposite sides of the button, a rotating sheet axially connected to the housing and passing through the first and second acting plates, and a rotating plate axially connected to the housing and elastically connected to the rotating sheet, and wherein a sleeve is formed at one end of the rotating sheet, and a positioning rod is vertically disposed on the housing and positioned in the sleeve, such that when the rotating sheet swings, the sleeve collides with the positioning rod.

In an embodiment, the regulating assembly comprises a rotating plate axially connected to the housing and an electromagnetic valve interlocked with the rotating plate.

According to the door lock device of the present disclosure, the operating assembly is regulated into the interlocking state or the idle state through the regulating assembly. As such, when the target handle serves as an outdoor handle, a user can regulate the operating assembly and the outdoor handle into the idle state so as not to interlock the operating assembly and the acting assembly. Therefore, compared to the prior art, the outdoor handle cannot operate the lock tongue when the door lock device of the present disclosure is locked. Hence, if the outdoor handle is forced to rotate (for example, impacted by an external force or forced to rotate by an unscrupulous person), neither the operating assembly nor the acting assembly will be affected (i.e., the lock tongue maintains a good locking state), thus avoiding damage of the operating assembly and ensuring safe and normal use of the door.

Further, since the security post is made of a hot melt material, the security post will melt when the door lock device is at high temperature. Consequently, the fireproof sheet covering the lock tongue base falls down due to its own weight and comes into contact with the acting post. As a result, the acting assembly is stuck and cannot be interlocked with the lock tongue. Therefore, when the door lock device is locked, in case of an outdoor fire, the security post will melt so as to prevent the acting assembly from being interlocked with the lock tongue, thus preventing the door from being opened and achieving a fire isolation effect and further preventing an indoor person from mistakenly opening the door. Therefore, the door lock device complies with the fire safety regulations and can be applied to the configuration of fire doors.

BRIEF DESCRIPTION OF THE DRAWINGS

FIG. 4B' is a schematic plan view showing an action process of a target key and a regulating assembly when a door lock device is equipped with a fastening member according to the present disclosure;

DETAILED DESCRIPTION

The following illustrative embodiments are provided to illustrate the present disclosure, these and other advantages and effects can be apparent to those in the art after reading this specification.

It should be noted that all the drawings are not intended to limit the present disclosure. Various modifications and variations can be made without departing from the spirit of the present disclosure. Further, terms such as "up," "first," "second," "third," "a," etc., are merely for illustrative purposes and should not be construed to limit the scope of the present disclosure.

Figure 1:
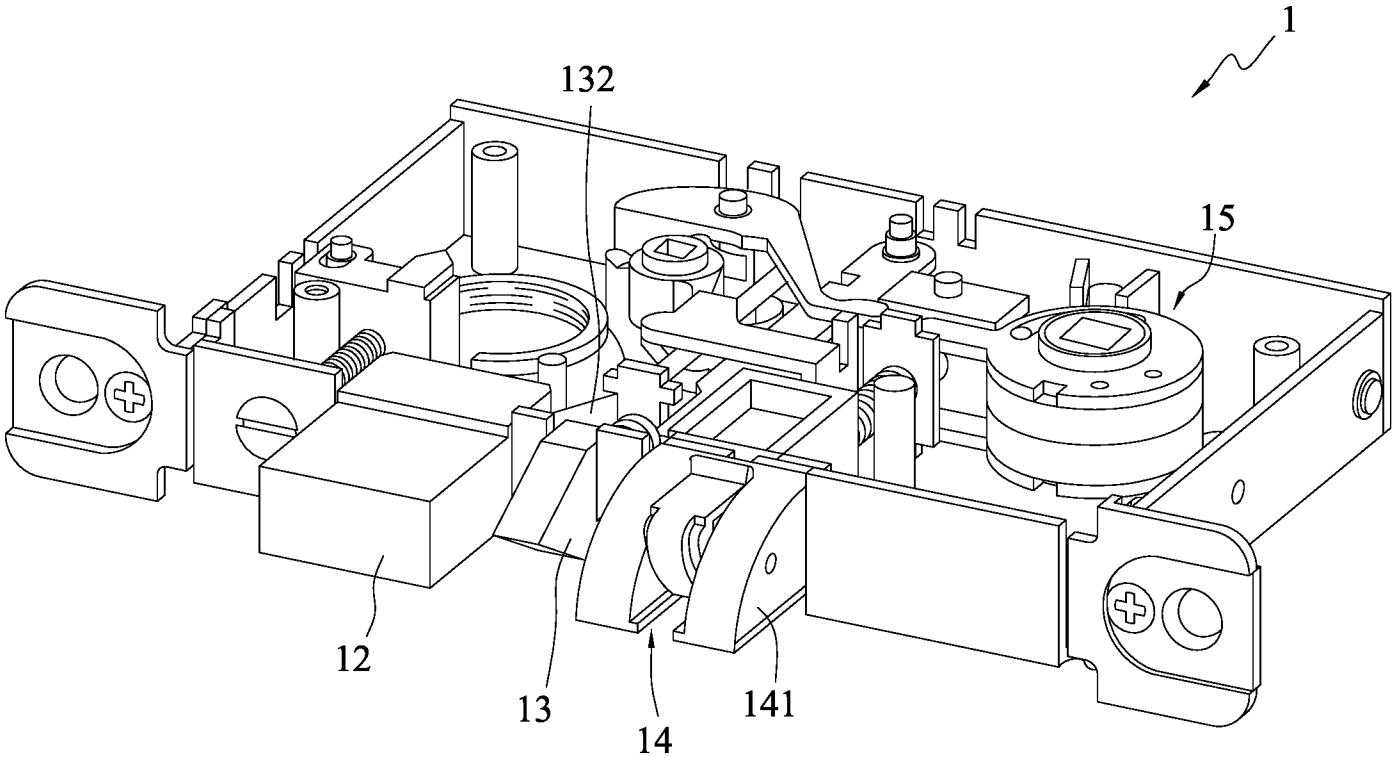
FIG. 1 (PRIOR ART)
FIG. 1 is a partial perspective view of a conventional door lock structure.
Figure 2A:
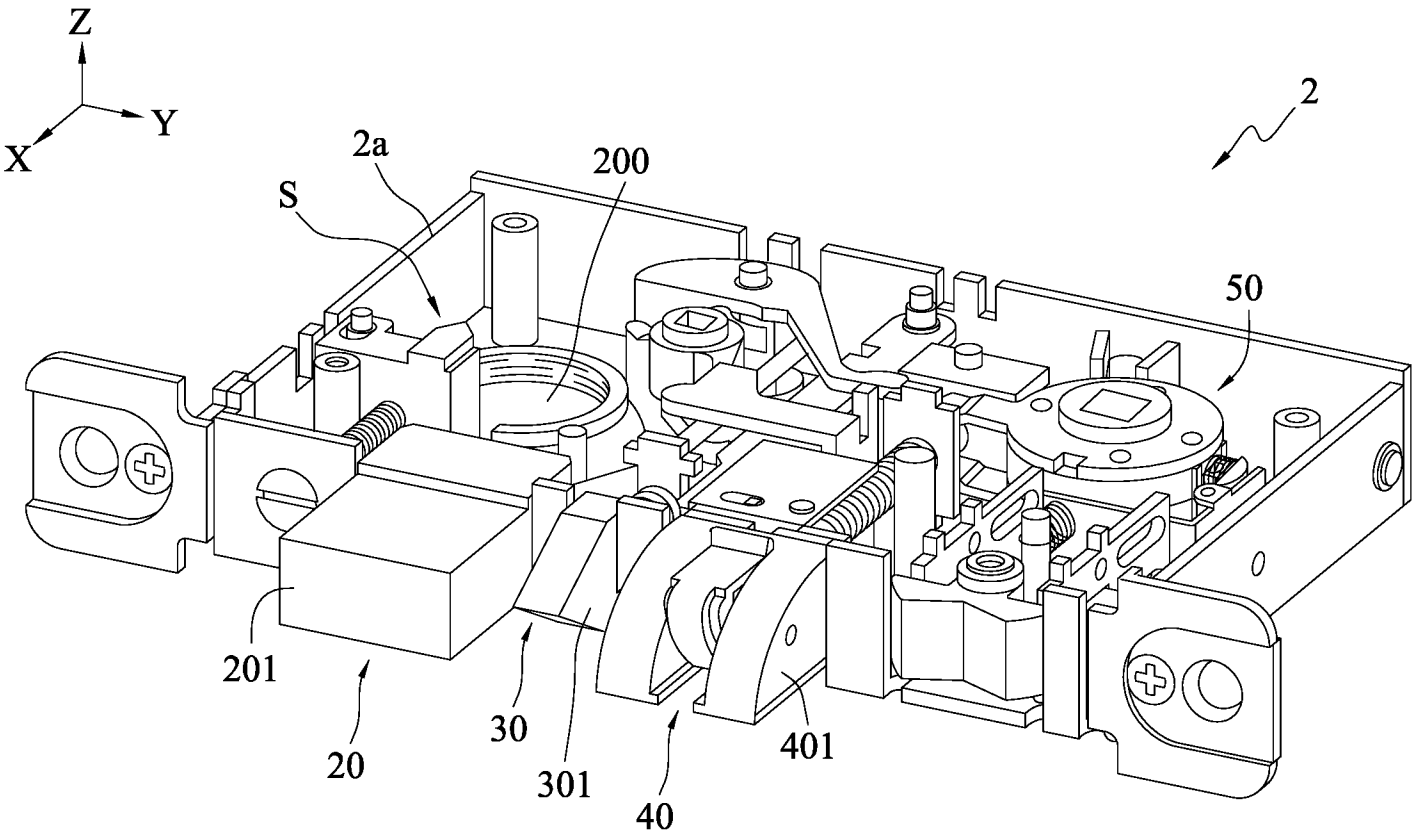
FIG. 2A is a schematic partial assembly perspective view of a door lock device according to a first embodiment of the present disclosure.
Figure 2B:
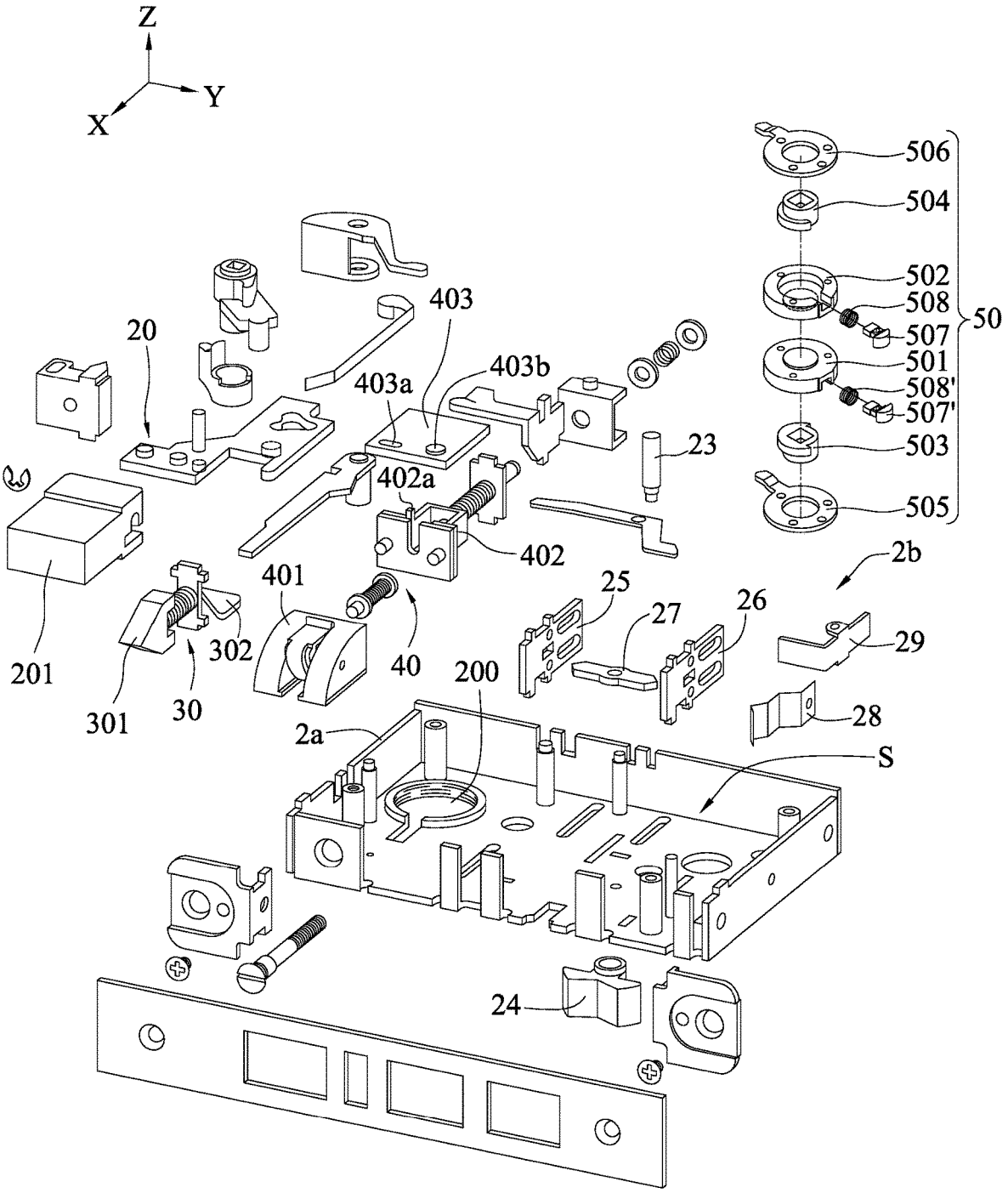
FIG. 2B is a partially exploded perspective view of FIG. 2A.

FIGS. 2A, 2B, 2C, 3A, 3B and 3C are schematic views showing a door lock device 2 according to a first embodiment of the present disclosure. Referring to FIGS. 2A and 2B, the door lock device 2 has: a housing 2*a*, a regulating assembly 2*b*, a first acting assembly 20, a second acting assembly 30, a third acting assembly 40, and an operating assembly 50.

In an embodiment, a front or rear direction such as an arrow direction X is defined along an extending or retraction direction of a lock head 201 of the door lock device 2, a left or right direction such as an arrow direction Y is defined along a height direction of the door lock device 2, and an up or down direction such as an arrow direction Z is defined along a thickness direction of the door lock device 2. It should be noted that the orientations of the arrow directions X, Y and Z are used for illustrative purposes and not intended to limit the present disclosure.

Figure 2C:
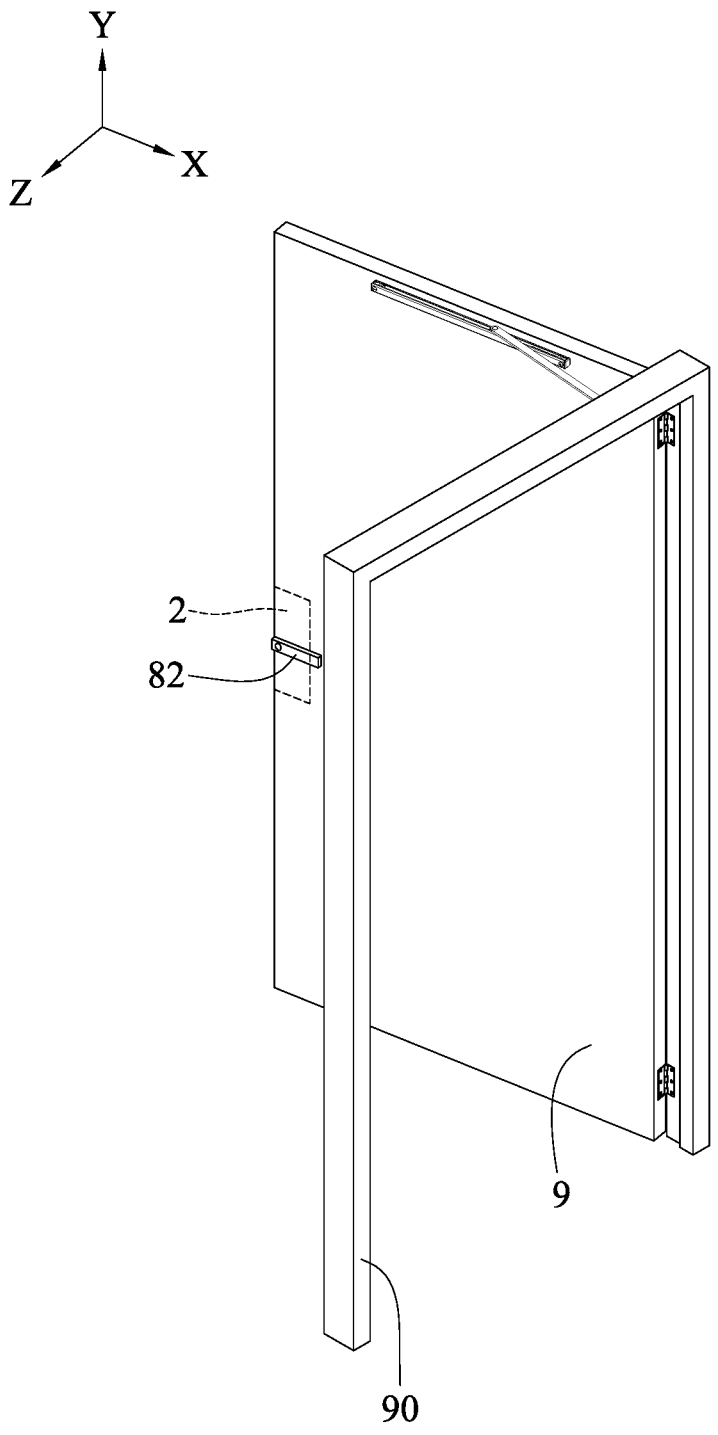
FIG. 2C is an exploded perspective view of a door lock device mounted on a fire door according to the present disclosure.

Further, referring to FIG. 2C, the door lock device 2 is disposed inside a door body 9 pivotally connected to a door frame 90.

The housing 2*a* is in the shape of a rectangular box, which has a receiving space S and a cover member (not shown) covering the receiving space S. An acting post 23 (as shown in FIG. 2B) and other components of the door lock device 2 are received in the housing 2*a*.

Figure 3A:
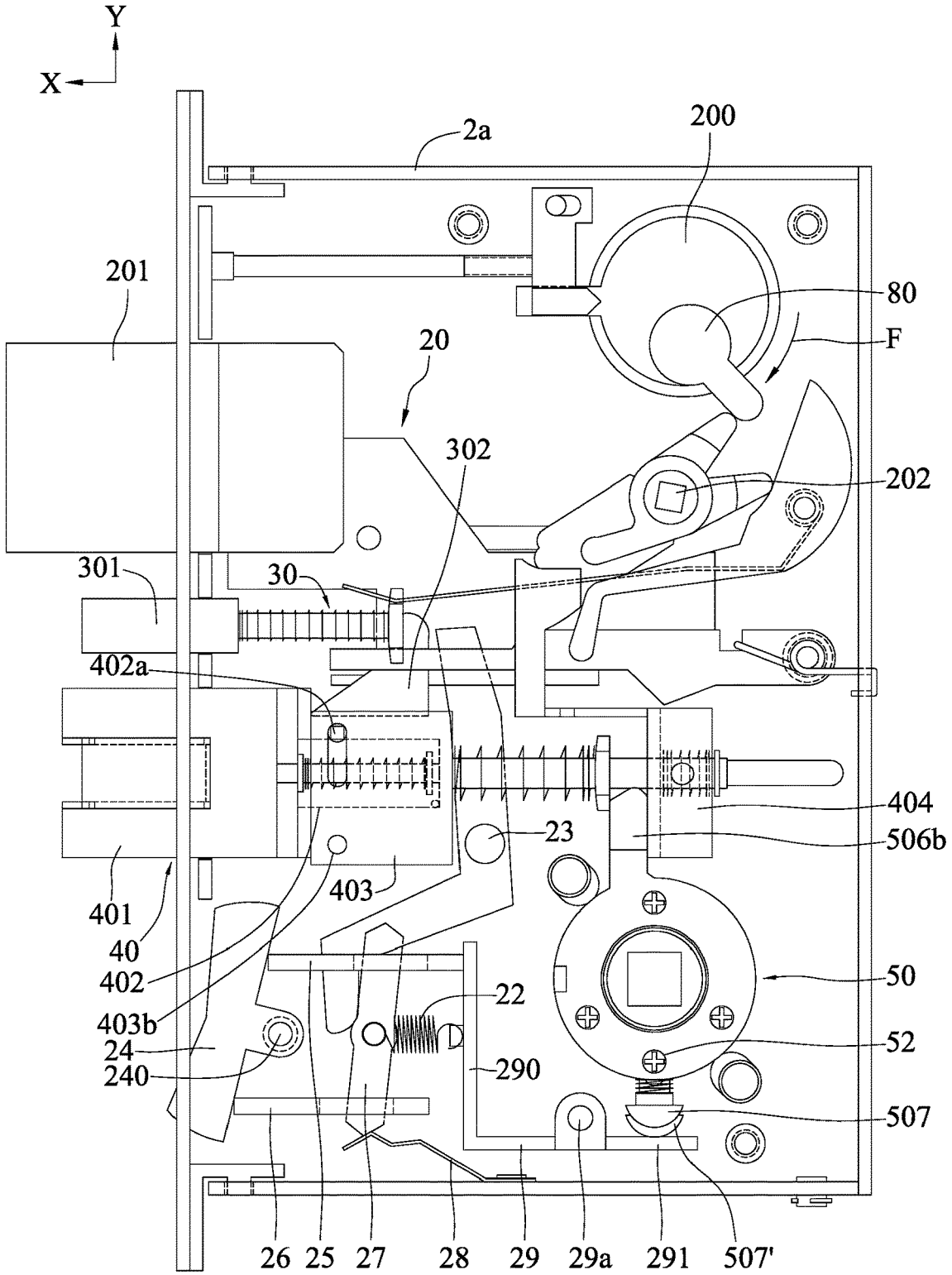
FIG. 3A is a schematic plan view of FIG. 2A.

In an embodiment, the housing 2*a* has a key hole 200 communicating with the receiving space S so as for a target key 80 (as shown in FIG. 3A) to be inserted into the key hole 200 from outdoors, thereby actuating the first acting assembly 20 and the second acting assembly 30 (in an action direction F of FIG. 3A). It should be noted that in indoors, the first acting assembly 20 can be interlocked through a knob (at a shaft joint 202 of FIG. 3A).

The regulating assembly 2*b* has a rocker-shaped button 24 exposed from the receiving space S and pivotally connected to the housing 2*a* (for example, at a shaft joint 240). When one side of the button 24 is pressed, it is inclined toward the other side of the button 24. Further, the regulating assembly 2*b* has a first acting plate 25 and a second acting plate 26 arranged in the receiving space S and linearly displaceable. As such, either side of the button 24 abuts against one of the first acting plate 25 and the second acting plate 26. Further, a rotating sheet 27 is axially connected to the housing 2*a* and inserted into holes of the first acting plate 25 and the second acting plate 26. For example, the rotating sheet 27 has triangular cone-shaped ends. One end of the rotating sheet 27 close to the bottom of the housing 2*a* is connected to the bottom of the housing 2*a* through an M-shaped bent elastic sheet 28. The elastic sheet 28 applies pressure to the rotating sheet 27 so as to position the rotating sheet 27. As such, the rotating sheet 27 can form a two-stage toggle position by using the elastic sheet 28.

Further, the regulating assembly 2*b* has a right angle bent rotating plate 29 axially connected to a pivot portion 29*a* on the housing 2*a* and corresponding to the first acting plate 25 and the second acting plate 26. In operation, a bent portion 290 on one side of the rotating plate 29 is interlocked with another end of one of the first acting plate 25 and the second acting plate 26. For example, the bent portion 290 of the rotating plate 29 close to the rotating sheet 27 is connected to one end of a spring 22 and the other end of the spring 22 is connected to a shaft portion 27*a* of the rotating sheet 27. As such, the spring 22 applies a pulling force onto the rotating plate 29 so as to cause the rotating plate 29 to rotate based on the pivot portion 29*a*.

The first acting assembly 20 has a lock head 201. The lock head 201 is actuated by inserting the target key 80 into the key hole 200 (or through an indoor knob) so as to extend out of or retract into the receiving space S. When the lock head 201 extends out of the receiving space S, the lock head 201 engages with a lock hole (not shown) on the door frame 90 to present a locking state.

The second acting assembly 30 has a security bolt 301. The security bolt 301 can retract into the receiving space S so as to cause the second acting assembly 30 to stop the third acting assembly 40.

The third acting assembly 40 has a lock tongue 401. By rotating at least one target handle 81, 82 disposed on the door body 9 to drive the third acting assembly 40, the lock tongue 401 extends out of or retracts into the receiving space S. When the lock tongue 401 extends out of the receiving space S, the lock tongue 401 engages with a lock tongue hole (not shown) on the door frame 90 so as to present another locking state.

In an embodiment, referring to FIGS. 2B and 3A, the third acting assembly 40 further has a lock tongue base 402 connected to a rear end of the lock tongue 401 and a fireproof sheet 403 covering above the lock tongue base 402. A guiding post 402*a* is formed on an upper edge of the lock tongue base 402 and an oblong oval shaped guiding slot 403*a* is formed on an upper side of the fireproof sheet 403. The guiding post 402*a* can be displaceably disposed in the guiding slot 403*a* so as to allow the fireproof sheet 403 to slide relative to the lock tongue base 402.

Moreover, referring to FIGS. 2B and 3A, the acting post 23 is disposed close to the fireproof sheet 403. Further, the fireproof sheet 403 has a security post 403*b* made of a hot melt material, which extends from the upper side of the fireproof sheet 403 to the lower side of the fireproof sheet 403 and protrudes into and engages with the lock tongue base 402. As such, the fireproof sheet 403 can be hung on the lock tongue base 402 without falling.

Therefore, referring to FIGS. 2B and 3A, if a fire occurs in the use environment of the door lock device 2, the security post 403*b* of the fireproof sheet 403 of the third acting assembly 40 will melt at high temperature and no longer engage with the lock tongue base 402. As such, the fireproof sheet 403 falls from the lock tongue base 402 to a position between the lock tongue base 402 and the acting post 23 of the housing 2*a*. Therefore, the lock tongue base 402 cannot extend or retract. That is, the locking state of the third acting assembly 40 cannot be released by using the operating assembly 50 (detailed below). Consequently, the door body 9 cannot be opened, thereby preventing an indoor or outdoor person from mistakenly opening the door body 9. As such, the door body 9 can prevent the fire from rushing indoors so as to achieve a fire isolation effect and protect the indoor person from the fire.

Figure 3B:
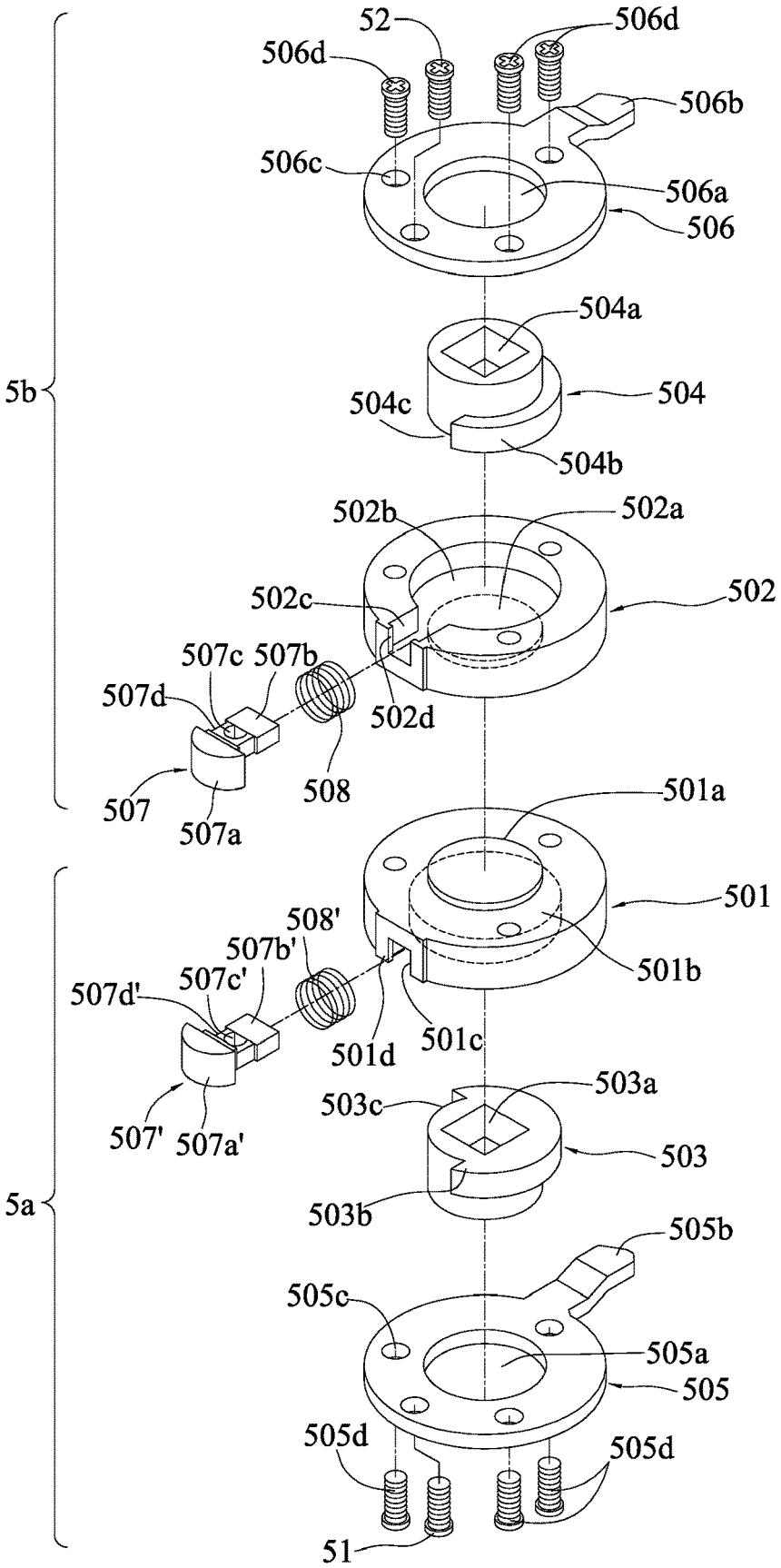
FIG. 3B is a partially enlarged exploded perspective view of FIG. 2B.
Figure 3C:
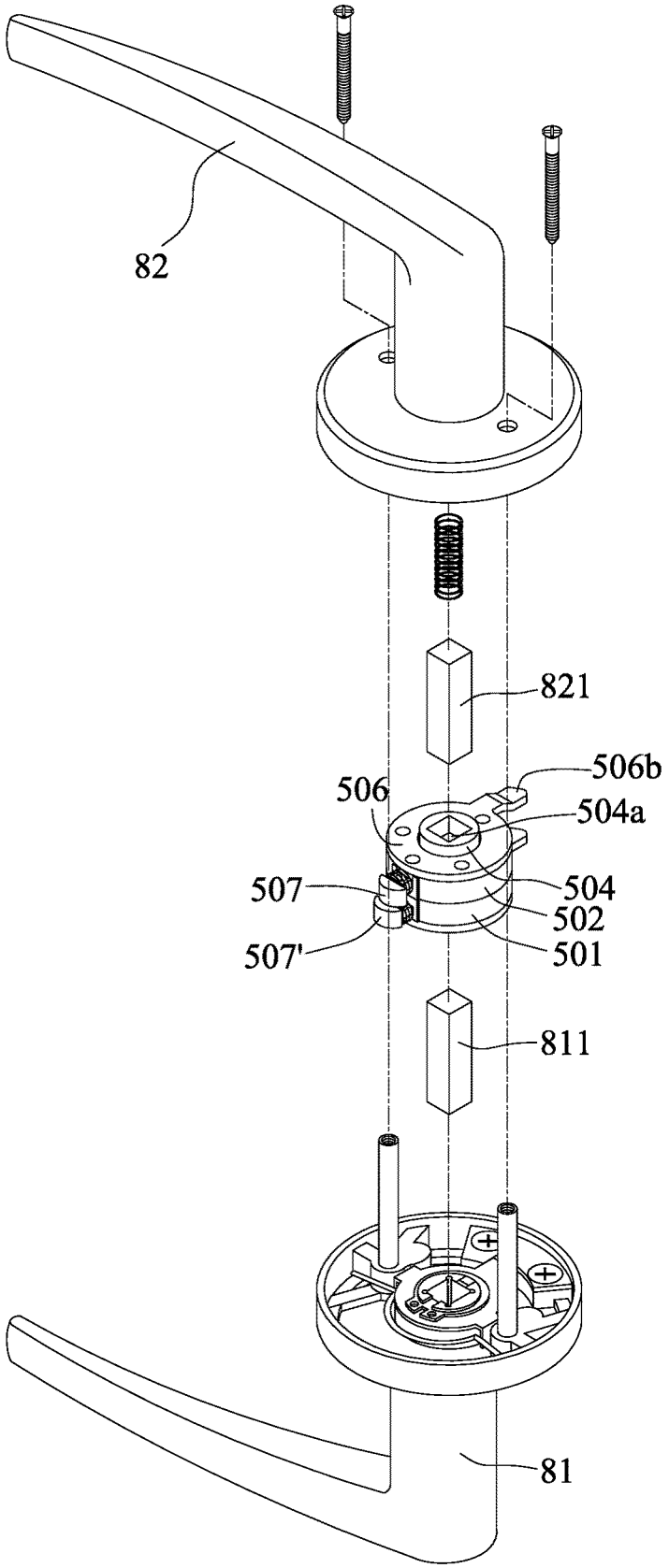
FIG. 3C is a partially exploded perspective view of a door lock device and cooperating target handles according to the present disclosure.

The operating assembly 50 is connected to the target handle 81, 82 and the third acting assembly 40 so as to drive the lock tongue 401 of the third acting assembly 40 to move back and forth when the target handle 81, 82 (as shown in FIG. 3C) is rotated.

In an embodiment, the operating assembly 50 has a bidirectional action mechanism according to the number of the target handle 81, 82. Referring to FIGS. 2B and 3B, the operating assembly 50 has a first base body 501, a second base body 502 stacked on a top side of the first base body 501, a first rotating member 503 disposed on a bottom side of the first base body 501, a second rotating member 504 disposed on a top side of the second base body 502, a first sheet body 505 disposed on the bottom side of the first base body 501 and around the first rotating member 503, and a second sheet body 506 disposed on the top side of the second base body 502 and around the second rotating member 504. For example, the first base body 501, the first rotating member 503 and the first sheet body 505 can be regarded as a first operating mechanism 5*a*, and the second base body 502, the second rotating member 504 and the second sheet body 506 can be regarded as a second operating mechanism 5*b*. The first and second operating mechanisms 5*a*, 5*b* act in the same manner.

The first base body 501 has a ring shape. A circular protruding portion 501*a* is formed on a center of a top surface of the first base body 501, an n-shaped first sliding slot 501*c* is formed on a peripheral surface of the first base body 501, a circular first recess portion 501*b* is formed on a bottom of the first base body 501 (as shown in dashed lines of FIG. 3B), and a first position limiting portion 501*d* is formed at an outer end of the first sliding slot 501*c*.

The second base body 502 has a ring shape. A circular second recess portion 502*b* is formed on a center of a top surface of the second base body 502, a circular recess portion 502*a* is formed on a bottom of the second base body 502 and around the protruding portion 501*a*, an U-shaped second sliding slot 502*c* is formed on a peripheral surface of the second base body 502, and a second position limiting portion 502*d* is formed at an outer end of the second sliding slot 502*c*.

The first rotating member 503 is substantially of a cylinder shape and arranged in the first recess portion 501*b* of the first base body 501 from bottom to top. Further, a first bolt slot 503*a* of a square shape is formed at a center of the first rotating member 503 for axially engaging with the target handle 81 (as shown in FIG. 3C), and a first flange portion 503*b* is formed around a portion of a peripheral surface of the first rotating member 503 inside the first base body 501, and the remaining portion of the peripheral surface of the first rotating member 503 inside the first base body 501 forms a first notch 503*c*.

The second rotating member 504 is substantially of a cylinder shape and arranged in the second recess portion 502*b* of the second base body 502 from top to bottom. Further, a second bolt slot 504*a* of a square shape is formed at a center of the second rotating member 504 for axially engaging with the target handle 82 (as shown in FIG. 3C), and a second flange portion 504*b* is formed around a portion of a peripheral surface of the second rotating member 504 inside the second base body 502, and the remaining portion of the peripheral surface of the second rotating member 504 inside the second base body 502 forms a second notch 504*c*.

The first sheet body 505 has a ring shape. A circular first through hole 505*a* is formed at a center of the first sheet body 505 so as to allow the first rotating member 503 to pass therethrough. The first rotating member 503 passes through the first base body 501 and the first sheet body 505 and protrudes from the first sheet body 505 for engaging with the target handle 81. Further, a first stop arm 505*b* of a bent shape extends from an edge of the first sheet body 505 and abuts against a driving member 404 of the third acting assembly 40. Furthermore, a plurality of circular first openings 505*c* are formed on a ring body of the first sheet body 505 so as to allow a plurality of first screws 505*d* to pass therethrough and lock the first sheet body 505 and the first base body 501.

The second sheet body 506 has a ring shape. A circular second through hole 506*a* is formed at a center of the second sheet body 506 so as to allow the second rotating member 504 to pass therethrough. The second rotating member 504 passes through the second base body 502 and the second sheet body 506 and protrudes from the second sheet body 506 for engaging with the target handle 82. Further, a second stop arm 506*b* of a bent shape extends from an edge of the second sheet body 506 and abuts against the driving member 404 of the third acting assembly 40. Furthermore, a plurality of circular second openings 506*c* are formed on a ring body of the second sheet body 506 so as to allow a plurality of second screws 506*d* to pass therethrough and lock the second sheet body 506 and the second base body 502.

Further, the operating assembly 50 has a plurality of sliding blocks 507, 507' engaging with the first sliding slot 501*c* and the second sliding slot 502*c*. A circular arc cap shaped pressing portion 507*a*, 507*a*' is formed at one end of the sliding block 507, 507' and a blocking portion 507*b*, 507*b*' is formed at the other end of the sliding block 507, 507'. Furthermore, a middle portion 507*d*, 507*d*' narrower than the pressing portion 507*a*, 507*a*' and the blocking portion 507*b*, 507*b*' is formed between the two ends of the sliding block 507, 507', and a through hole 507*c*, 507*c*' is formed at a center of the middle portion 507*d*, 507*d*'. For example, an elastic element 508, 508' such as a compression spring is disposed around the middle portion 507*d*, 507*d*' of the sliding block 507, 507'. The outer diameter of the elastic element 508, 508' is greater than the hole diameter of the first sliding slot 501*c* and the second sliding slot 502*c*. As such, the elastic elements 508, 508' are clamped outside the first sliding slot 501*c* and the second sliding slot 502*c*, and the first position limiting portion 501*d* and the second position limiting portion 502*d* engage with the middle portions 507*d*, 507*d*' of the sliding blocks 507, 507' so as to prevent the sliding blocks 507, 507' from falling off. For example, the elastic elements 508, 508' can generate an outward pushing force on the sliding blocks 507, 507'.

In addition, the door lock device 2 can be configured with a first fastening member 51 and a second fastening member 52 such as screws based on requirements. The first fastening member 51 and the second fastening member 52 can be passed through the first opening 505*c*, the second opening 506*c* and the through holes 507*c*, 507*c*' of the middle portions 507*d*, 507*d*' of the sliding blocks 507, 507' so as to fasten the sliding blocks 507, 507' between the first sheet body 505 and the first base body 501 and between the second sheet body 506 and the second base body 502, respectively.

During the use of the door lock device 2, the target key 80 (or the indoor knob) can drive the lock head 201 and the security bolt 301 to extend or retract relative to the receiving space S, thereby locking or unlocking the door lock device 2. Also, through the operating assembly 50, the target handle 81, 82 can drive the lock tongue 401 to extend or retract relative to the receiving space S, thereby locking or unlocking the door lock device 2.

In an embodiment, the second operating mechanism 5*b* of the operating assembly 50 (i.e., the second sheet body 506, the second rotating member 504 and the second base body 502) is described.

Figure 4A:
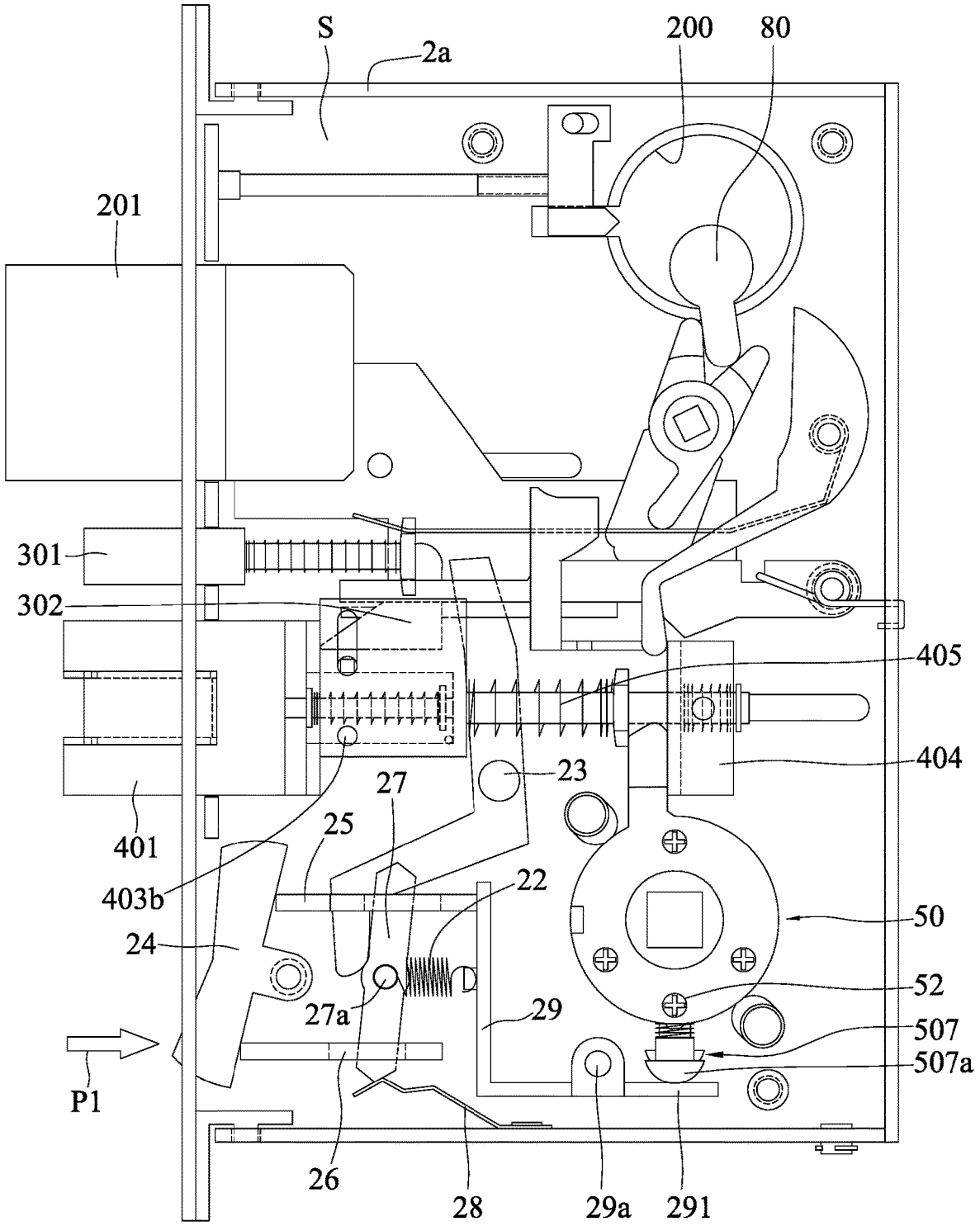
FIGS. 4A and 4B are schematic plan views showing an action process of a door lock device when being equipped with a fastening member according to the present disclosure.
Figure 4B:
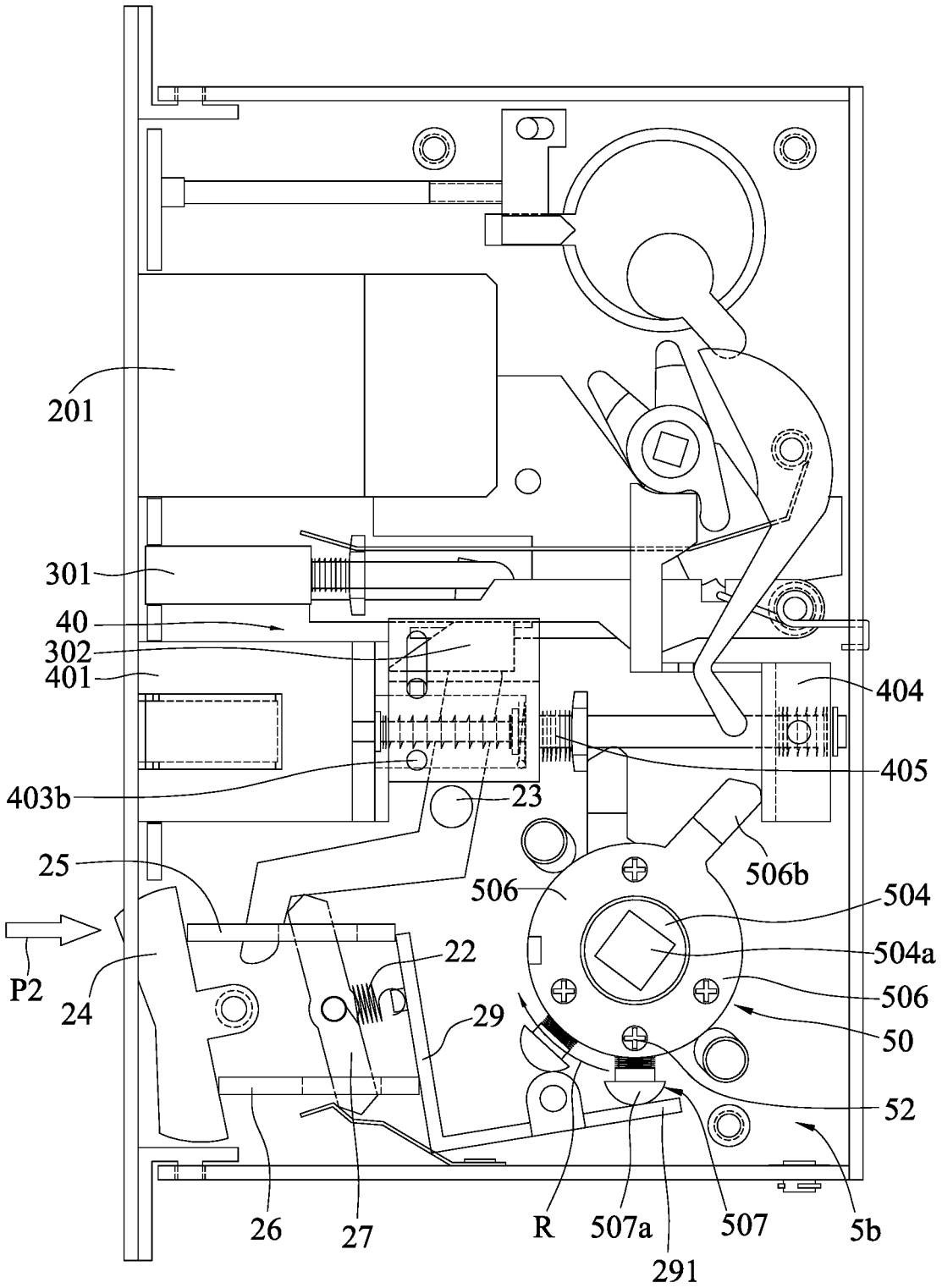
Figure 4B:
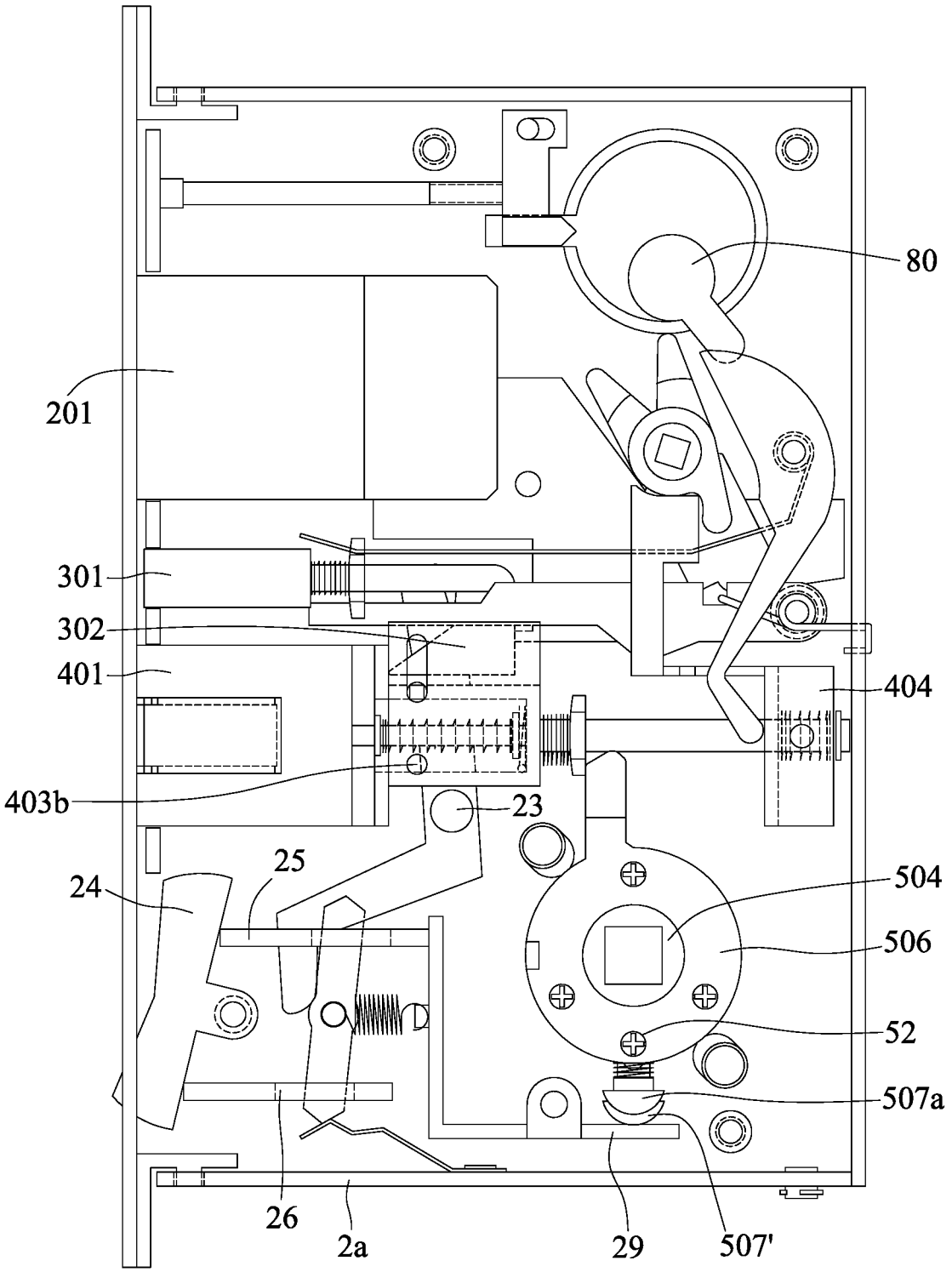

Referring to FIGS. 4A and 4B, when assembling the door lock device 2, an assembler first passes the second fastening member 52 through the second opening 506*c* and causes the door lock device 2 to present a locking state (the lock head 201, the security bolt 301 and the lock tongue 401 extend out of the receiving space S). Then, the assembler presses the button 24 toward a position corresponding to the second acting plate 26 (a pressing force P1 of FIG. 4A) so as to cause the button 24 to change from one stage of the two-stage toggle position to the other stage. As such, the rotating sheet 27 drives the spring 22 to pull the rotating plate 29 to rotate, thereby causing a bent portion 291 of the other side of the rotating plate 29 to push the pressing portion 507*a* of the sliding block 507. When the sliding block 507 is pressed, the blocking portion 507*b* slides into the second sliding slot 502*c* of the second base body 502 and abuts against the second notch 504*c* of the second rotating member 504 so as to engage with the second flange portion 504*b* of the second rotating member 504. Therefore, the second rotating member 504 and the second base body 502 are engaged together. At this point, the through hole 507*c* of the middle portion 507*d* of the sliding block 507 is aligned with the second openings 506*c*. Then, the assembler passes the second fastening member 52 through the through hole 507*c* so as to fasten the sliding block 507 onto the second sheet body 506, thus connecting the second rotating member 504, the second base body 502, the sliding block 507 and the second sheet body 506 together. Thereafter, the assembler engages the target handle 82 with the second bolt slot 504*a* of the second rotating member 504 through a pivot shaft 821 (as shown in FIG. 3C).

After the door lock device 2 is mounted onto the door body 9 (as shown in FIG. 2C), a user (or an indoor person) rotates the target handle 82 so as to drive the second sheet body 506, the second rotating member 504 and the second base body 502 to rotate synchronously (in a rotation direction R of FIG. 4B). As such, the stop arm 506*b* of the second sheet body 506 is interlocked with the driving member 404 of the third acting assembly 40. That is, the lock tongue 401 is moved backward by a rod 405 so as to retract into the receiving space S, thus unlocking the door lock device 2 (or moved forward by the rod 405 so as to extend out of the receiving space S, thus locking the door lock device 2). At this point, the target handle 82 and the second operating mechanism 5*b* of the operating assembly 50 maintain an interlocking state to drive the lock tongue 401 to extend or retract.

Further, if the user presses the button 24 toward a position corresponding to the first acting plate 25 (a pressing force P2 of FIG. 4B), the rotating sheet 27 drives the rotating plate 29 to rotate through the spring 22, thus causing the bent portion 291 of the other side of the rotating plate 29 to separate from the pressing portion 507*a* of the sliding block 507 (as shown in FIG. 4B'). However, the spring force of the elastic element 508 cannot push the sliding block 507 outward. Therefore, no matter how the user presses the button 24, since the sliding block 507 is fastened by the second fastening member 52, the target handle 82 and the second operating mechanism 5*b* of the operating assembly 50 maintain the interlocking state.

Furthermore, referring to FIG. 4B', the target key 80 drives the blocking plate 302 of the second acting assembly 30 to stop the lock tongue 401.

It should be understood that the method of actuating the lock head 201, the security bolt 301 and the lock tongue 401 by the target key 80 (or the indoor knob) is well known in the art (as shown in FIGS. 4A, 4B and 4B'). When the security bolt 301 retracts into the receiving space S (as shown in FIGS. 4B and 4B'), the blocking plate 302 of the second acting assembly 30 stops the driving member 404 and hence the third acting assembly 40 maintains its original state.

Therefore, based on the interlocking state of the second operating mechanism 5*b* of the operating assembly 50, the target handle 82 corresponding to the second operating mechanism 5*b* can be placed indoors so as to facilitate the user (or the indoor person) to go into or out of the door.

On the other hand, if the second fastening member 52 is removed during the assembling process of the door lock device 2, the target handle 82 in use cannot drive the lock tongue 401. Only the target key 80 can drive the lock head 201 and the security bolt 301 to extend or retract. Therefore, the door lock device 2 presents another locking state.

Figure 5A:
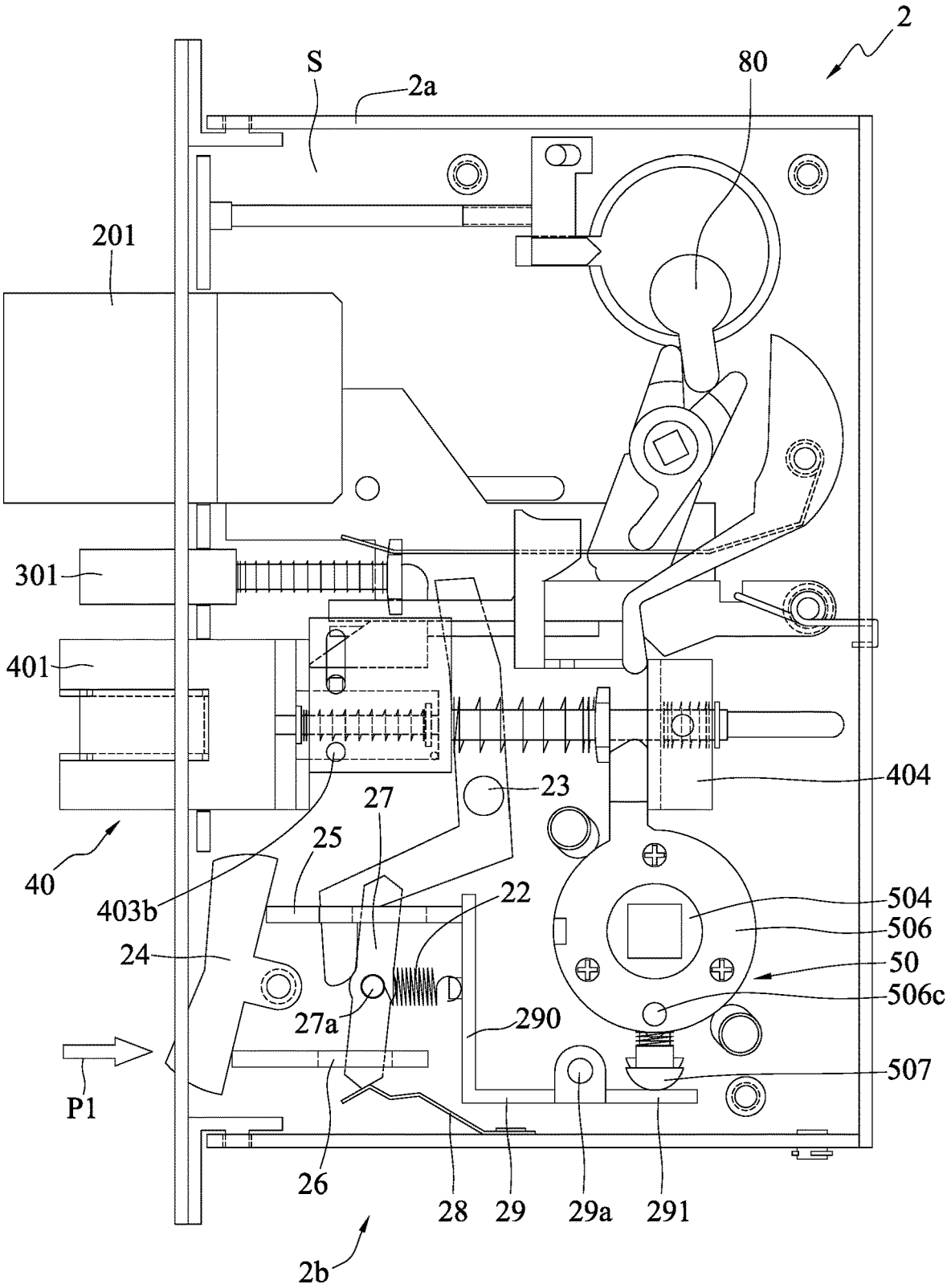
FIGS. 5A and 5B are schematic plan views showing an action process of a door lock device without a fastening member according to the present disclosure.
Figure 5B:
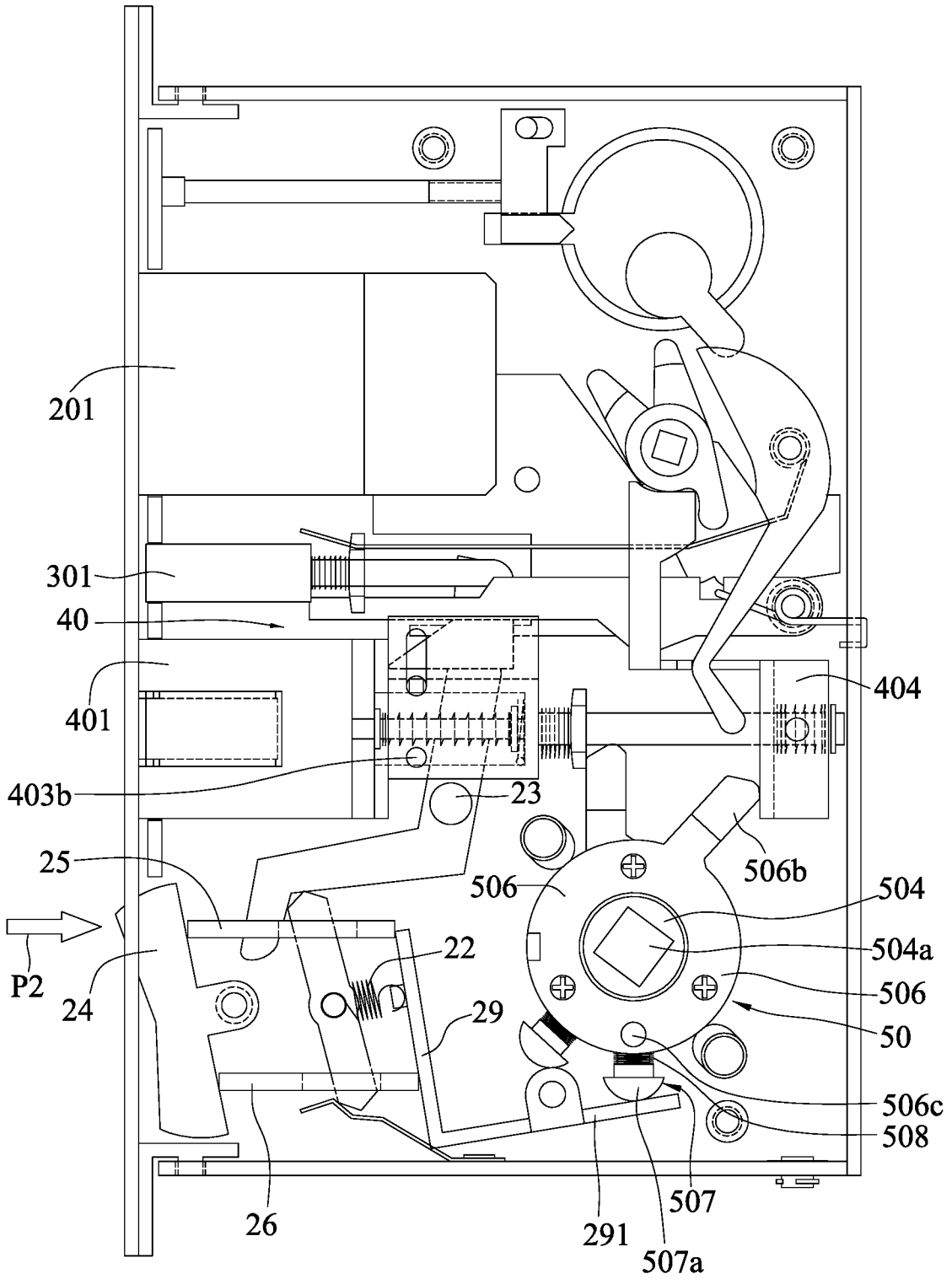

Referring to FIGS. 5A and 5B, when assembling the door lock device 2, the assembler first removes the second fastening member 52 from the second opening 506*c* and causes the door lock device 2 to present a locking state (the lock head 201, the security bolt 301 and the lock tongue 401 extend out of the receiving space S). Then, the assembler presses the button 24 toward a position corresponding to the second acting plate 26 (a pressing force P1 of FIG. 5A) so as to cause the button 24 to be at one stage of the two-stage toggle position. As such, the rotating sheet 27 drives the spring 22 to pull the rotating plate 29 to rotate, thereby pushing the sliding block 507 to slide into the second sliding slot 502*c* of the second base body 502 and engage with the second rotating member 504. At this point, the through hole 507*c* of the middle portion 507*d* of the sliding block 507 is aligned with the second openings 506*c*. However, the sliding block 507 cannot be fastened onto the second sheet body 506 without the second fastening member 52. At this point, since the rotating plate 29 abuts against the sliding block 507, when the target handle 82 is rotated, the stop arm 506*b* of the second sheet body 506 can still act in a manner as shown in FIG. 5B.

After the door lock device 2 is mounted onto the door body 9 (as shown in FIG. 2C) and the user presses the button 24 toward a position corresponding to the first acting plate 25 (a pressing force P2 of FIG. 5B), the button 24 is positioned at the other stage of the two-stage toggle position. The rotating sheet 27 drives the rotating plate 29 to rotate reversely through the spring 22, thus causing the bent portion 291 of the other side of the rotating plate 29 to separate from the pressing portion 507*a* of the sliding block 507. The spring force of the elastic element 508 pushes the sliding block 507 outward. Therefore, the blocking portion 507*b* of the sliding block 507 slides out of the second sliding slot 502*c* of the second base body 502 and abuts against the rotating plate 29 (as shown in FIG. 5A). At this point, the sliding block 507 is no longer connected with the second rotating member 504 and the second base body 502. Therefore, the second rotating member 504 cannot rotate synchronously with the second base body 502 (or the second sheet body 506).

Thereafter, when the user closes and locks the door body 9 (as shown in FIG. 5A), if the target handle 82 is rotated, since the second fastening member 52 is removed and the stop arm 506*b* of the second sheet body 506 cannot be interlocked with the driving member 404 of the third acting assembly 40, i.e., the lock tongue 401 does not displace, the target handle 82 cannot be interlocked with the third acting assembly 40 and hence enters into an idle state.

Therefore, based on the idle state of the second operating mechanism 5*b* of the operating assembly 50, the target handle 82 corresponding to the second operating mechanism 5*b* can be placed outdoors. As such, when the door lock device 2 is in a locking state (the lock head 201, the security bolt 301 and the lock tongue 401 extend out of the receiving space S), if the target handle 82 is impacted by an external object (or forced to rotate by an unscrupulous person), the operating assembly 50 will not be damaged since the target handle 82 is in the idle state. Even if the target handle 82 is damaged, it is only necessary to replace the target handle 82 (the repair cost is quite low), and the operation of the door lock device 2 is still normal.

It should be understood that the user can press the button 24 so as to cause the target handle 82 and the second operating mechanism 5*b* of the operating assembly 50 to enter into the interlocking state or the idle state.

On the other hand, since the first operating mechanism and the second operating mechanism act in the same manner, as shown in FIG. 3C, the first operating mechanism can mount the target handle 81 through a pivot shaft 811 so as to enter into an interlocking state or an idle state. Therefore, during the assembling process of the door lock device 2, the first fastening member 51 and/or the second fastening member 52 can be mounted or removed according to the requirement so as to cause the first operating mechanism and/or second operating mechanism to enter into the interlocking state or the idle state. Hence, the target handle having the idle state can be mounted outdoors and the target handle having the interlocking state can be mounted indoors, or the target handle having the idle state can be mounted both indoors and outdoors, or the target handle having the interlocking state can be mounted both indoors and outdoors.

Figure 6:
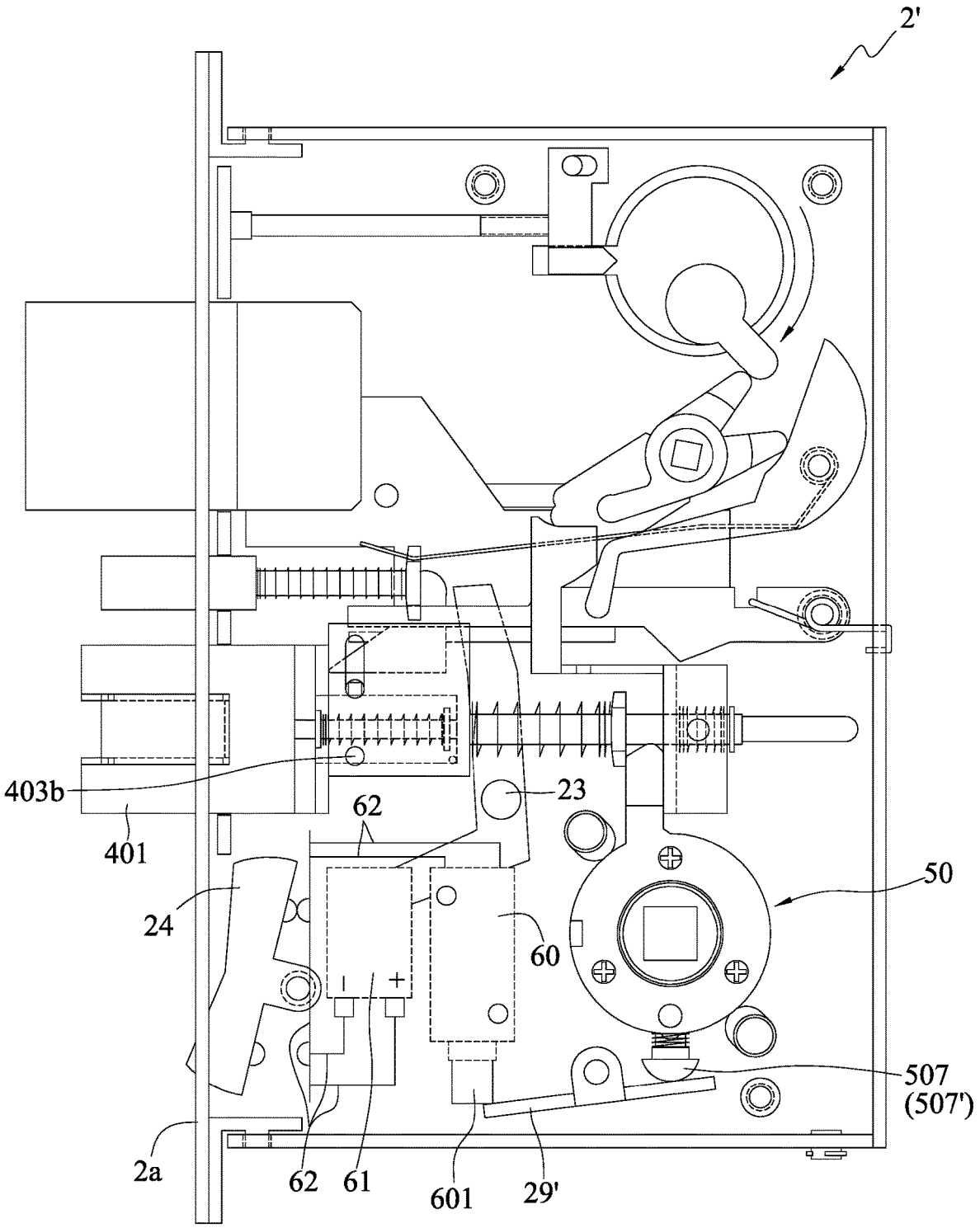
FIG. 6 is a schematic partial plan view of a door lock device according to a second embodiment of the present disclosure.

FIG. 6 is a schematic view of a door lock device 2' according to a second embodiment of the present disclosure. The present embodiment differs from the first embodiment in the construction of the regulating assembly 2*b*, and those that are the same will not be repeated below.

Referring to FIG. 6, the regulating assembly 2*b* has an electromagnetic valve 60 interlocked with a rotating plate 29' and a battery 61 actuating the electromagnetic valve 60. The rotating plate 29' has a flat plate shape.

The electromagnetic valve 60 acts when being supplied with an electric current. For example, a guiding rod 601 extends outward to push one end of the rotating plate 29', thus causing the other end of the rotating plate 29' to go upward and push the sliding block 507, 507'.

The battery 61 provides an electric current into the electromagnetic valve 60 so as to drive the electromagnetic valve 60 to extend the guiding rod 601.

In an embodiment, the electric current output action of the battery 60 is controlled by the button 24. For example, the button 24 is an electrical switch, which connects the battery 61 and the electromagnetic valve 60 through wires 62. Therefore, by selecting the pressing direction of the button 24 to control the action of the electromagnetic valve 60, the guiding rod 601 of the electromagnetic valve 60 can be extended or retracted to control the rotation of the rotating plate 29' to thereby push the sliding block 507.

Since the wires 62 can be arranged according to the requirement, the arranging position of the electromagnetic valve 60 and the battery 61 can be more flexible. Therefore, the first and second acting plates 25, 26, the rotating sheet 27 and the elastic sheet 28 can be replaced by the electromagnetic valve 60, the battery 61 and the wires 62 so as to improve the flexibility of arrangement of the regulating assembly 2*b*.

Figure 7A:
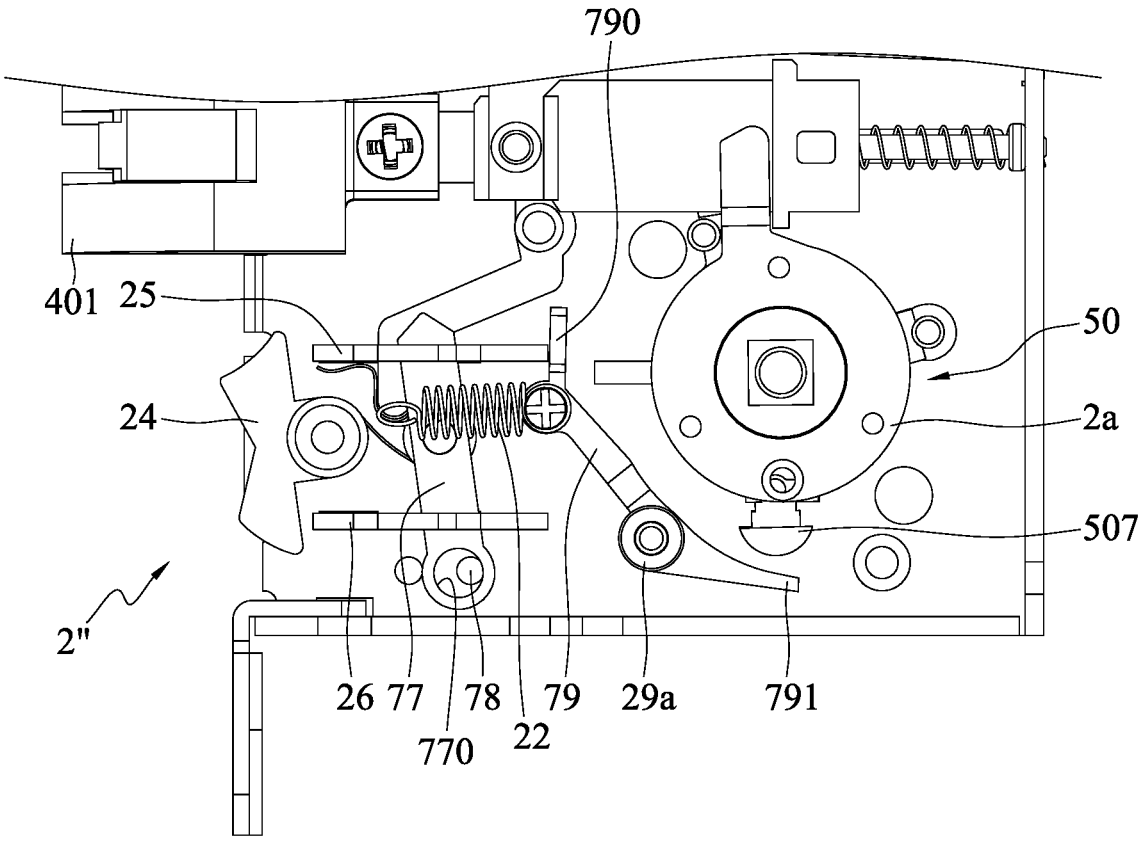
FIG. 7A is a schematic partial plan view of a door lock device according to a third embodiment of the present disclosure.
Figure 7B:
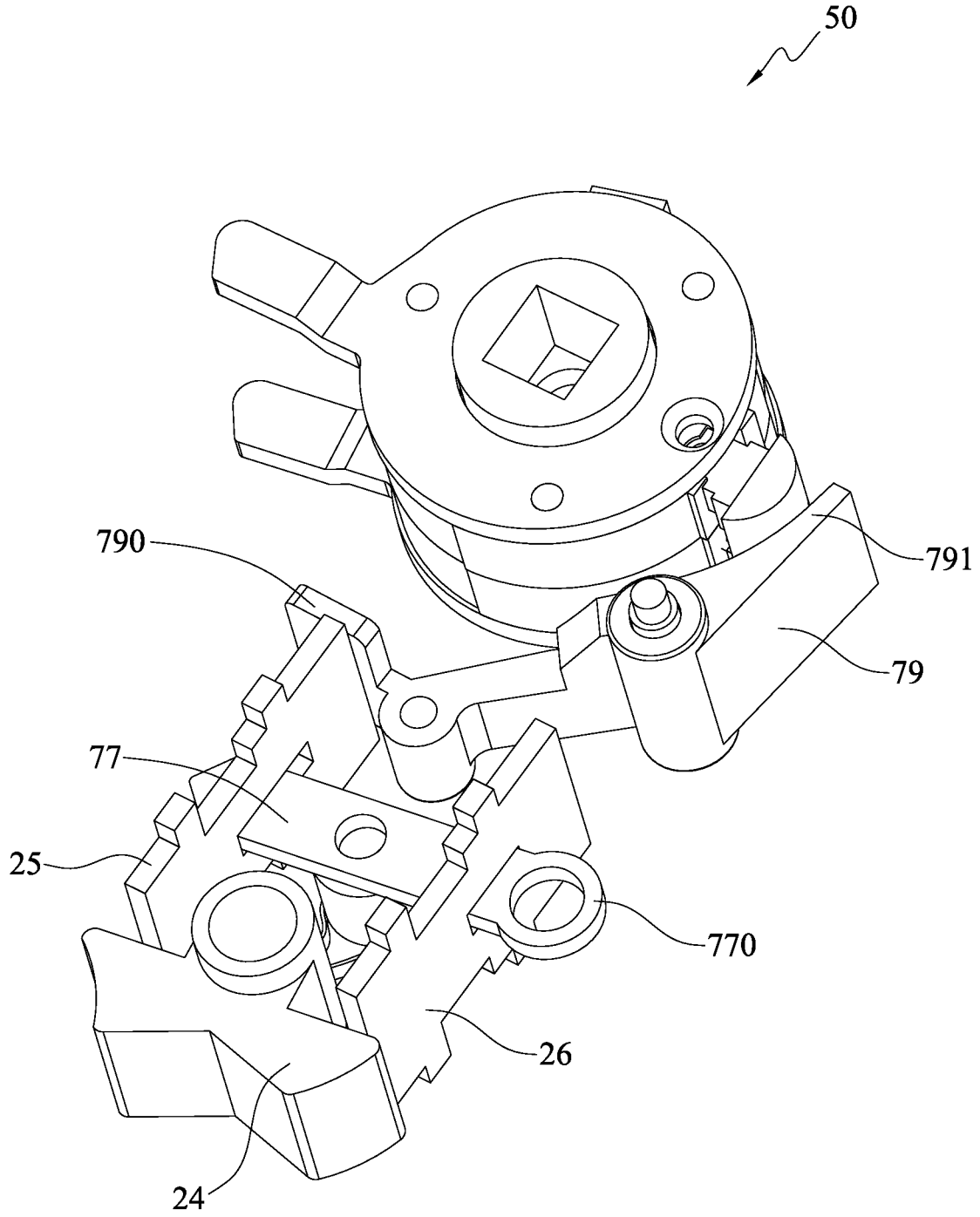
FIG. 7B is a partially exploded perspective view of FIG. 7A.

FIGS. 7A and 7B are schematic views showing a door lock device 2" according to a third embodiment of the present disclosure. The present embodiment differs from the first embodiment in the shape of the regulating assembly 2*b*, and those that are the same will not be repeated below.

Referring to FIGS. 7A and 7B, a sleeve 770 is formed at one end of the rotating sheet 77, and a positioning rod 78 is vertically disposed on the housing 2*a* and arranged in the sleeve 770. When the rotating sheet 77 swings, the sleeve 770 collides with the positioning rod 78. As such, the rotating sheet 77 forms a two-stage toggle position through cooperation between the sleeve 770 and the positioning rod 78.

In an embodiment, the rotating plate 79 is in the shape of a curved knife, which has a handle 790 corresponding to the first acting plate 25. In operation, the first acting plate 25 is interlocked with a blade 791 of the rotating plate 79. For example, the spring 22 is connected to the handle 790 of the rotating plate 79. The spring 22 applies an elastic force on the rotating plate 79 so as to cause the rotating plate 79 to rotate the blade 791 based on the pivot portion 29*a*. When the button 24 drives the first acting plate 25 to push the handle 790, the blade 791 of the rotating plate 79 moves away from the sliding block 507. On the other hand, when the button 24 drives the first acting plate 25 to move away from the handle 790, the blade 791 of the rotating plate 79 pushes the sliding block 507 through the elastic force of the spring 22.

Figure 8A:
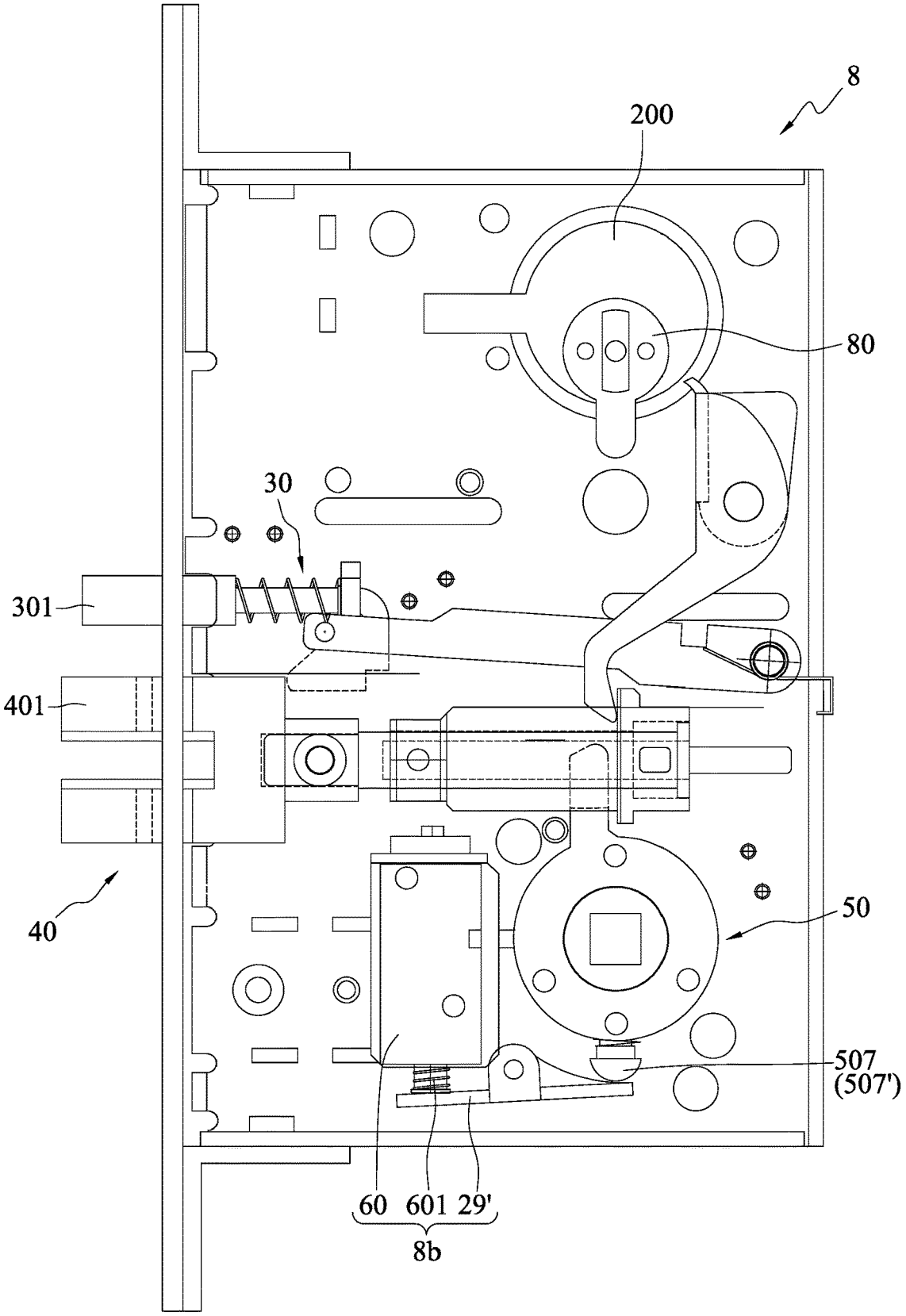
FIGS. 8A and 8B are schematic partial plan views showing an action process of a door lock device according to a fourth embodiment of the present disclosure.
Figure 8B:
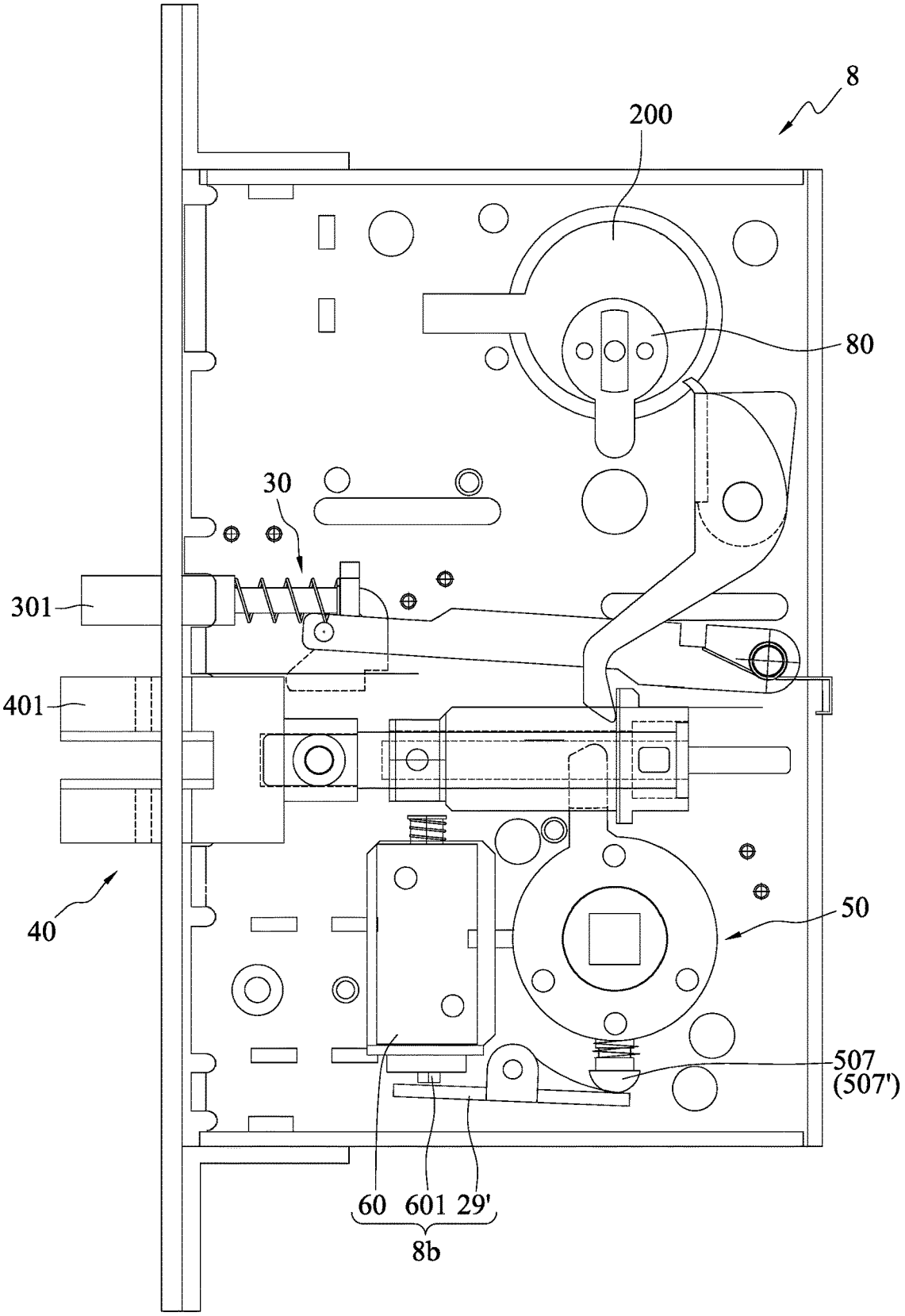

FIGS. 8A and 8B are schematic views showing a door lock device 8 according to a fourth embodiment of the present disclosure. The present embodiment differs from the second embodiment in the construction of the regulating assembly 8*b*, and those that are the same will not be repeated below.

Referring to FIGS. 8A and 8B, the door lock device 8 is in the form of an electronic lock, and the regulating assembly 8*b* has a rotating plate 29' and an electromagnetic valve 60 interlocked with the rotating plate 29'.

In use, the electromagnetic valve 60 senses an inductive magnetic card (not shown) and generates an electric current so as to extend a guiding rod 601 to push one end of the rotating plate 29', thus causing the other end of the rotating plate 29' to go upward and push the sliding block 507, 507'. On the other hand, after the electromagnetic valve 60 is turned off, the guiding rod 601 retracts to drive one end of the rotating plate 29' to go up, thereby causing the sliding block 507, 507' to push the other end of the rotating plate 29'.

Therefore, through the design of the door lock device 8 in the form of an electronic lock, the button 24, the first and second acting plates 25, 26, the rotating sheet 27 and the elastic sheet 28 are replaced by the electromagnetic valve 60 so as to increase the arrangement area of the receiving space S of the housing 2*a*, thereby improving the flexibility of arrangement of the components of the electronic lock.

According to the door lock device 2, 2', 2", 8 of the present disclosure, by removing the fastening member (the first or second fastening member 51, 52) of the operating mechanism corresponding to the outdoor handle, the target handle 81, 82 and the operating assembly 50 can enter into an interlocking state or an idle state according to the requirement. If the target handle 81, 82 serves as an outdoor handle, the user can regulate the operating assembly 50 and the outdoor handle into the idle state through the button 24 or the inductive magnetic card (not shown). As such, the outdoor handle cannot operate the lock tongue 401 when the door lock device 2, 2', 2", 8 is in a locking state. Therefore, if the outdoor handle is forced to rotate, the operating assembly 50 is prevented from being damaged.

Further, by using the security post 403*b* as a fireproof mechanism, the door lock device 2, 2', 2", 8 can meet the requirements of fire doors and therefore can be mounted on a fire door.

The above-described descriptions of the detailed embodiments are to illustrate the preferred implementation according to the present disclosure, and it is not to limit the scope of the present disclosure. Accordingly, all modifications and variations completed by those with ordinary skill in the art should fall within the scope of the present disclosure defined by the appended claims.

What is claimed is:

1. A door lock device, comprising:

a housing having a receiving space;

an acting assembly arranged in the receiving space and having a lock tongue;

an operating assembly arranged in the receiving space and interlocked with a target handle; and a regulating assembly arranged in the receiving space, wherein when the operating assembly is regulated into an interlocking state through the regulating assembly, the target handle drives the acting assembly through the operating assembly to cause the lock tongue to extend or retract relative to the housing, and wherein when the operating assembly is regulated into an idle state through the regulating assembly, the operating assembly is unable to drive the acting assembly and the target handle is unable to be interlocked with the lock tongue, wherein the regulating assembly comprises a button connected to the housing and exposed from the receiving space, a first acting plate and a second acting plate arranged at opposite sides of the button, a rotating sheet axially connected to the housing and passing through the first and second acting plates, and a rotating plate axially connected to the housing and elastically connected to the rotating sheet, and wherein a sleeve is formed at one end of the rotating sheet, and a positioning rod is vertically disposed on the housing and positioned in the sleeve, such that the sleeve collides with the positioning rod when the rotating sheet swings.

2. The door lock device of claim 1, wherein the operating assembly has at least one operating mechanism comprising a rotating member engaging with the target handle, a base body disposed around the rotating member, and a sheet body fixed on the base body and disposed around the rotating member.

3. The door lock device of claim 2, wherein the sheet body has a stop arm for cooperating and actuating with the acting assembly.

4. The door lock device of claim 2, further comprising a sliding slot formed on a peripheral surface of the base body and in communication with the rotating member.

5. The door lock device of claim 4, wherein the operating mechanism further comprises a sliding block engaging with the sliding slot to abut against or separate from the rotating member along the sliding slot.

6. The door lock device of claim 1, wherein the acting assembly further comprises a lock tongue base connected to the lock tongue and a fireproof sheet displaceably disposed on the lock tongue base, wherein the fireproof sheet has a security post made of a hot melt material, the security post protrudes into and engages with the lock tongue base, and an acting post is arranged in the receiving space of the housing corresponding to the fireproof sheet.

* * * * *